US008598459B2

(12) United States Patent
Eshima

(10) Patent No.: US 8,598,459 B2
(45) Date of Patent: Dec. 3, 2013

(54) SHIELDED CABLE

(75) Inventor: Hirotaka Eshima, Hitachi (JP)

(73) Assignee: Hitachi Cable, Ltd., Tokyo (JP)

( * ) Notice: Subject to any disclaimer, the term of this patent is extended or adjusted under 35 U.S.C. 154(b) by 356 days.

(21) Appl. No.: 12/923,406

(22) Filed: Sep. 20, 2010

(65) Prior Publication Data

US 2011/0079410 A1 Apr. 7, 2011

(30) Foreign Application Priority Data

Oct. 5, 2009 (JP) ..... 2009-231414
Jun. 23, 2010 (JP) ..... 2010-142392

(51) Int. Cl.
*H01B 7/18* (2006.01)

(52) U.S. Cl.
USPC ..... 174/102 R; 174/106 R; 174/107; 174/108; 174/24

(58) Field of Classification Search
USPC ..... 174/36, 102 R, 106 R, 107, 108, 113 R, 174/28
See application file for complete search history.

(56) References Cited

U.S. PATENT DOCUMENTS 2,313,234 A * 3/1943 Gavitt ..... 174/120 SR
3,649,744 A * 3/1972 Coleman ..... 174/107
4,408,089 A * 10/1983 Nixon ..... 174/34
4,552,989 A * 11/1985 Sass ..... 174/103
4,626,810 A * 12/1986 Nixon ..... 333/243
4,727,222 A * 2/1988 Sato ..... 174/108
5,304,739 A * 4/1994 Klug et al. ..... 174/102 R
5,463,188 A * 10/1995 Nohmi et al. ..... 174/108
5,477,011 A * 12/1995 Singles et al. ..... 174/102 R
5,510,578 A * 4/1996 Dunlavy ..... 174/128.1
5,554,236 A * 9/1996 Singles et al. ..... 156/52
6,479,753 B2 * 11/2002 Borg et al. ..... 174/113 R
6,677,534 B2 * 1/2004 Yamamoto et al. ..... 174/113 R
7,164,078 B2 * 1/2007 Grogl et al. ..... 174/36
7,323,640 B2 * 1/2008 Takahashi et al. ..... 174/106 R
2006/0254801 A1 * 11/2006 Stevens ..... 174/102 R
2010/0116541 A1 * 5/2010 Eshima ..... 174/388

FOREIGN PATENT DOCUMENTS

JP 7-29427 A 1/1995
JP 2002-313144 A 10/2002
JP 2006-31954 A 2/2006
JP 2007-80706 A 3/2007

* cited by examiner

*Primary Examiner* — William H Mayo, III
(74) *Attorney, Agent, or Firm* — McGinn Intellectual Property Law Group, PLLC

(57) ABSTRACT

A shielded cable includes a core comprising an insulated wire including an inner conductor and an insulation layer formed on an outer periphery of the inner conductor, a shield layer formed on an outer periphery of the core, and a jacket layer formed on an outer periphery of the shield layer. The shield layer includes a stranded conductor shield layer including a stranded conductor spirally wound around the core, and the stranded conductor includes a plurality of conductor strands stranded together. The shield layer may further include a tinsel copper braided shield layer or a metal plated strand braided shield layer that is formed between the core and the stranded conductor shield layer.

14 Claims, 3 Drawing Sheets

10 SHIELDED CABLE
13 CORE
14 STRANDED CONDUCTOR
16 JACKET LAYER

17 COPPER TINSEL BRAIDED SHIELD LAYER
18 METAL STRAND BRAIDED SHIELD LAYER

19 REINFORCING BRAIDED LAYER

SHIELDED CABLE

The present application is based on Japanese Patent Application Nos. 2009-231414 and 2010-142392 filed on Oct. 5, 2009 and Jun. 23, 2010, respectively, the entire contents of which are incorporated herein by reference.

BACKGROUND OF THE INVENTION

1. Field of the Invention

The invention relates to a shielded cable provided with a shield layer on a periphery of one or plural insulated wires, in particular, to a shielded cable excellent in bending durability and torsion durability.

2. Description of the Related Art

Conventionally, equipments such as electronic information equipment or household electrical appliance have a problem that an inverter, etc., placed in the equipment is a generation source of electromagnetic noise and the electromagnetic noise generated by the generation source is radiated (emitted) via a cable, resulting in adverse affect such as an improper operation, etc., on other peripheral devices.

In addition, there is a problem that the electromagnetic noise enters the cable in a reverse way, resulting in adverse affect such as an improper operation, etc., on the device.

A conventional technique for solving the above problems is to provide a shielded cable in which a shield layer for shielding the electromagnetic noise is provided on an outer periphery of a cable (insulated wire). The types of the shield cable include a metal wire served shielded cable, a metal wire braided shielded cable or a tinsel copper braided shielded cable. It is possible to suppress the radiation of the electromagnetic noise as well as electromagnetic noise contamination via a cable by using the above shielded cables and connecting the shield layer to ground potential.

The related arts to the invention are, e.g., JP-A-2007-80706, JP-A-7-29427, JP-A-2002-313144 and JP-A-2006-031954.

SUMMARY OF THE INVENTION

Along with the popularization of robots and use of in-vehicle electronics, a shielded cable recently has been often arranged in an environment where the cable is repeatedly and often bent or twisted, accordingly, the shield cable has been required to have excellent bending durability and torsion durability.

However, the above-mentioned conventional shield cable has the following problems.

First of all, the metal wire braided shielded cable has a problem that metal wires grind against each other due to bend or torsion of the shielded cable and the metal wire forming a shield layer is likely to be disconnected by friction.

Meanwhile, the metal wire served shielded cable has excellent bending durability compared with the above-mentioned metal wire braided shielded cable, but has a problem in the torsion that the metal wire forming a shield layer is likely to be disconnected in the same manner as the metal wire braided shielded cable since large strain is generated when the shielded cable is twisted.

In addition, there is a risk that the disconnected metal wire comes into contact with an inner conductor of a cable (insulated wire) by piercing and penetrating an insulation layer of the cable (insulated wire), resulting in occurrence of short circuit.

As described above, the disconnection of the metal wire forming the shield layer relates to a bending life of the shielded cable, and thus a very important issue.

As a shielded cable which solves the above problem, there is a tinsel copper braid shielded cable with improved bending durability and torsion durability.

However, since electrical resistance of the shield layer in the tinsel copper braid shielded cable is about ten times larger than that of other conventional shielded cables, there is a problem that, in an environment where noise current of several amperes or more flows, a temperature increase in the shield layer may be too large and the usage environment is thus limited.

As described above, it is difficult to simultaneously realize high bending durability, high torsion durability and suppression of the temperature increase in the shield layer in the conventional shielded cable.

It is an object of the invention to provide a shielded cable that has excellent bending durability and torsion durability, and is provided with a shield layer in which a temperature increase is suppressed when noise current of several amperes or more flows.

(1) According to one embodiment of the invention, a shielded cable comprises:

a core comprising an insulated wire comprising an inner conductor and an insulation layer formed on an outer periphery of the inner conductor;

a shield layer formed on an outer periphery of the core; and a jacket layer formed on an outer periphery of the shield layer, wherein the shield layer comprises a stranded conductor shield layer comprising a stranded conductor spirally wound around the core, and the stranded conductor comprises a plurality of conductor strands stranded together.

In the above embodiment (1) of the invention, the following modifications and changes can be made.

(i) The shield layer further comprises a tinsel copper braided shield layer that is formed between the core and the stranded conductor shield layer and includes a plurality of braided copper tinsels each of which comprises a core thread and a copper foil wrapped thereon.

(ii) The shield layer further comprises a metal plated strand braided shield layer that is formed between the core and the stranded conductor shield layer and includes a plurality of braided metal plated strands each of which comprises a core thread plated with a metal.

(iii) A winding angle defined by the stranded conductor and a central axis of the core is 10° to 80° when the stranded conductor is spirally wound around the outer periphery of the core.

(iv) A winding angle defined by the stranded conductor and a central axis of the core is 30° to 80° when the stranded conductor is spirally wound around the outer periphery of the core.

(v) The shielded cable further comprises a reinforcing braided layer that is formed between the shield layer and the jacket layer and comprises braided shock-absorbing fibers.

(vi) The stranded conductor further comprises a lubricant applied to the plurality of conductor strands.

(vii) The lubricant comprises silicon oil.

According to one embodiment of the invention, a shielded cable is constructed such that a stranded conductor shield layer is formed by winding a stranded conductor around the outer periphery of a core, in order to enhance the bending durability and the torsion durability. Thereby, conductor strands are less likely to be disconnected and it is possible to suppress the temperature increase in the shield layer when the noise current of several amperes or more flows.

BRIEF DESCRIPTION OF THE DRAWINGS

Next, the present invention will be explained in more detail in conjunction with appended drawings, wherein.

DETAILED DESCRIPTION OF THE PREFERRED EMBODIMENTS

A preferred embodiment of the invention will be described in detail below in conjunction with the appended drawings.

Figure 1:
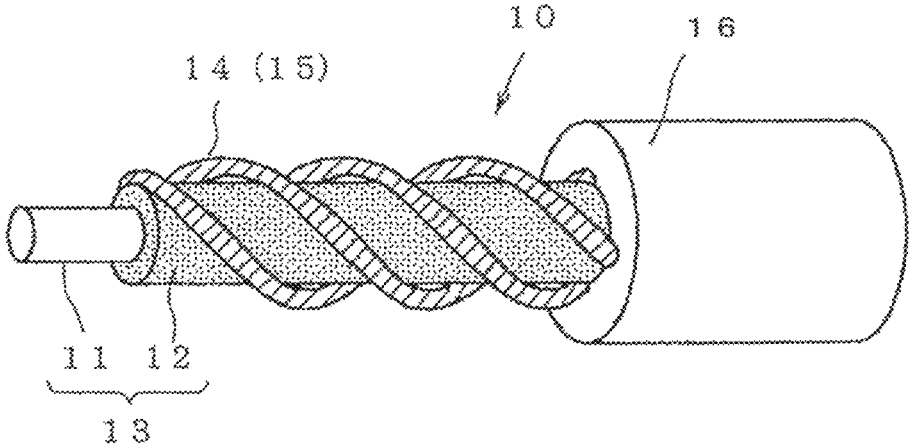
FIG. 1 is a perspective view showing a shielded cable in an embodiment of the present invention.

In FIG. 1, a core 13 is an insulated wire in which an insulation 12 covers an outer periphery of an inner conductor 11, a stranded conductor shield layer 15 as a shield layer for shielding electromagnetic noise is formed on an outer periphery of the core 13 by spirally winding one or plural stranded conductors 14 each of which is formed by twisting plural conductor strands (metal wires) and a shielded cable 10 is then formed by coating an outer periphery of the stranded conductor shield layer 15 with a jacket layer 16. Alternatively, the core 13 may be composed of plural insulated wires instead of one insulated wire in the embodiment of FIG. 1. In this case, the stranded conductor 14 is spirally wound around plural insulated wires all together.

In addition, the conductor strands should be twisted together after application of silicon oil as lubricant thereto when the stranded conductor 14 is formed by twisting the conductor strands.

Figure 2:
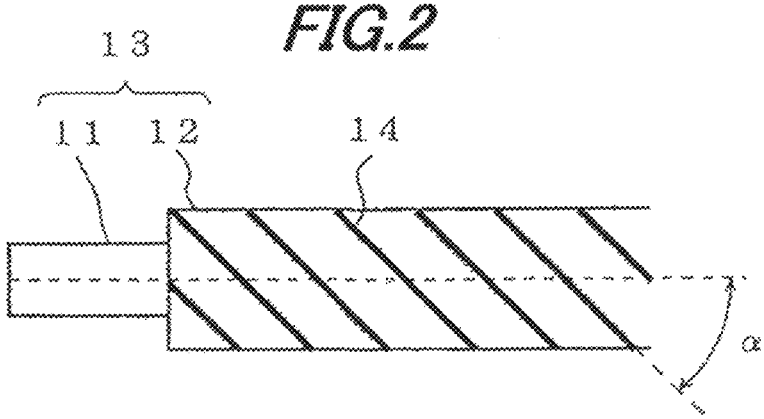
FIG. 2 is an explanatory view showing the shielded cable of FIG. 1 for explaining a winding angle α which is an angle defined by a stranded conductor wound around a core and a central axis of the core.

FIG. 2 is an explanatory view for explaining an angle α which is an angle defined by the wound stranded conductor 14 and a central axis of the core 13 when the stranded conductor 14 is wound around an outer periphery of the core 13 shown in FIG. 1. The angle α shown in FIG. 2 is 10-80°, and 30-80° is even preferable. Due to performance of manufacturing machine, the preferable angle is about 30±5° including an error.

As described above, the bending durability and the torsion durability are excellent since the stranded conductor shield layer 15 is formed by winding the stranded conductor 14 around the outer periphery of the core 13, as a result, the conductor strand is less likely to be disconnected and it is possible to suppress the temperature increase in the shield layer when the noise current of several amperes or more flows.

Figure 3:
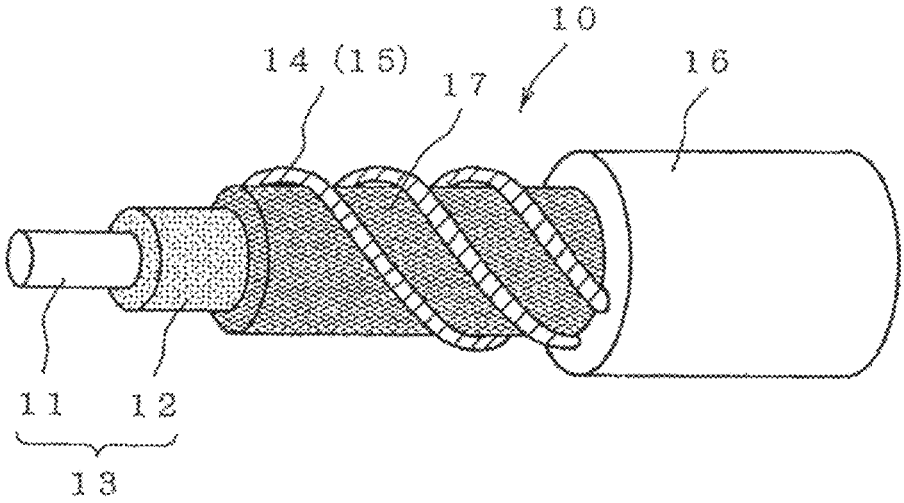
FIG. 3 is a perspective view showing a shielded cable in another embodiment of the invention.
Figure 4:
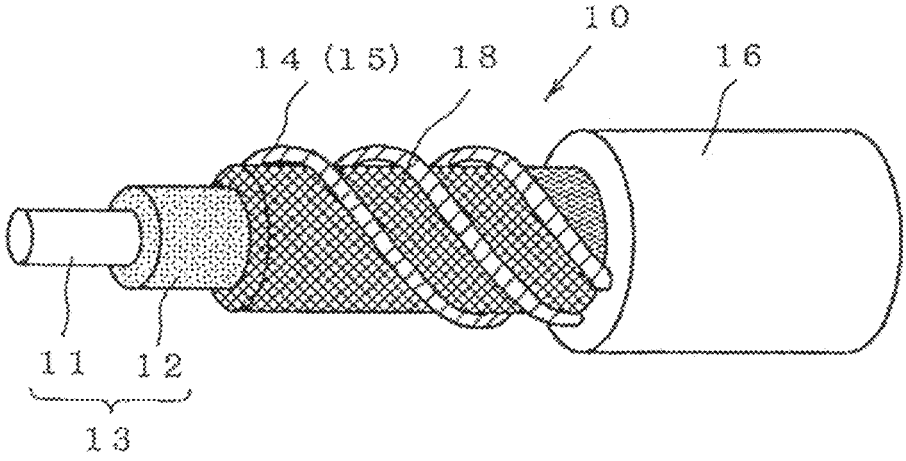
FIG. 4 is a perspective view showing a shielded cable in a modification of FIG. 3.

FIGS. 3 and 4 show another embodiment of the invention.

In the embodiment of FIG. 3, the stranded conductor 14 is not wound directly around the core 13 shown in FIG. 1, and a tinsel copper braided shield layer 17 formed by braiding plural tinsel coppers each of which is a core thread with copper foil wrapped therearound is formed on an outer periphery of the core 13 between the core 13 and the stranded conductor 14 spirally would around the core 13, i.e., between the core 13 and the stranded conductor shield layer 15. In the case of the embodiment of FIG. 3, a shield layer is composed of both the stranded conductor shield layer 15 and the tinsel copper braided shield layer 17.

Next, in the embodiment of FIG. 4, a metal strand braided shield layer 18 formed by braiding plural metal plated strands (metallic thread) each of which is a core thread plated with metal is formed instead of the tinsel copper braided shield layer 17 of FIG. 3. In the case of the embodiment of FIG. 4, a shield layer is composed of both the stranded conductor shield layer 15 and the metal strand braided shield layer 18.

Also in the shielded cables 10 of FIGS. 3 and 4, the bending durability and the torsion durability are excellent and thus the conductor strand is less likely to be disconnected, and it is possible to suppress the temperature increase in the shield layer when the noise current of several amperes or more flows, in the same manner as the embodiment of FIG. 1. Furthermore, since the shield layer is two-layered, shielding performance is high compared with the embodiment of FIG. 1.

Figure 5:
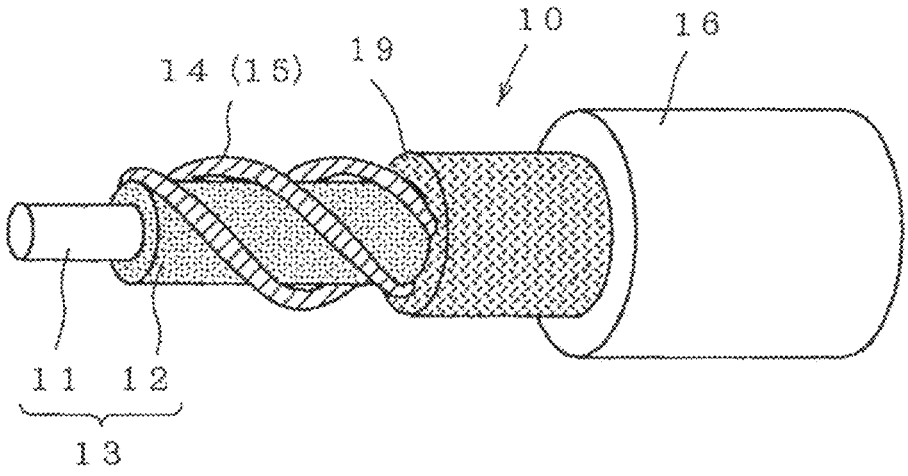
FIG. 5 is a perspective view showing a shielded cable in still another embodiment of the invention.

FIG. 5 shows still another embodiment of the invention.

In the embodiment of FIG. 5, a reinforcing braided layer 19 formed by braiding shock-absorbing fibers is formed on an outer periphery of the stranded conductor shield layer 15 as a shield layer between the stranded conductor shield layer 15 and the jacket layer 16 in the cable of the embodiment of FIG. 1.

Strength at the time of bending or twisting the stranded conductor shield layer 15 composed of the stranded conductor 14 can be enhanced by forming the reinforcing braided layer 19. The reinforcing braided layer 19 can be applied not only to the embodiment of FIG. 1 but also to the embodiments of FIGS. 3 and 4 in the same manner, and it is possible to obtain the same effect.

EXAMPLES

Example 1

A tinned soft conductor of ϕ 0.12 mm was used as the inner conductor 11 of the shielded cable 10 of FIG. 1 and the core 13 composed of an insulated wire was formed by coating an outer periphery of the tinned soft conductor with cross-linked polyethylene as the insulation 12. The stranded conductor 14 was formed by twisting plural tinned soft conductors of ϕ 0.12 mm, the stranded conductor shield layer 15 was then formed by winding four stranded conductors 14 around the outer periphery of the core 13 composed of one insulated wire at the winding angle of 30±5° with respect to the central axis of the core 13, and the outer periphery thereof was further coated with ethylene propylene diene rubber as the jacket layer 16, thereby forming the shielded cable.

Example 2

The shielded cable 10 of FIG. 3 was made under the same conditions as Example 1 except that the tinsel copper braided shield layer 17 was formed by braiding plural tinsel coppers (ϕ0.11 mm, copper foil thickness of 12 μm) each of which is a core thread with copper foil wrapped therearound, and was arranged between the core 13 and the stranded conductor shield layer 15.

Example 3

The shielded cable 10 of FIG. 4 was made under the same conditions as Example 1 except that the metal strand braided shield layer 18 was formed by braiding plural metal plated strands (ϕ0.12 mm) each of which is a core thread plated with metal, and was arranged between the core 13 and the stranded conductor shield layer 15.

Example 4

The shielded cable 10 of FIG. 5 was made under the same conditions as Example 1 except that the reinforcing braided layer 19 formed by braiding shock-absorbing fibers was formed and arranged between the stranded conductor shield layer 15 and the jacket layer 16.

Comparative Example 1

A shielded cable was made under the same conditions as Example 1 except that a single tinned soft conductor (ϕ0.12 mm) was used as the stranded conductor 14 forming the stranded conductor shield layer 15 in Example 1 and a single served shield layer was formed by winding the stranded conductor 14 at the winding angle of 30±5° so as to be densely arranged.

Comparative Example 2

A shielded cable was made under the same conditions as Example 2 except that the stranded conductor shield layer 15 in Example 2 was not provided.

Comparative Example 3

A shielded cable was made under the same conditions as Example 2 except that a single tinned soft conductor (ϕ0.12 mm) was used as the stranded conductor 14 forming the stranded conductor shield layer 15 in Example 2 and a single served shield layer was formed by winding the stranded conductor 14 at the winding angle of 30±5° so as to be densely arranged.

Comparative Example 4

A shielded cable was made under the same conditions as Example 3 except that the stranded conductor shield layer 15 in Example 3 was not provided.

Comparative Example 5

A shielded cable was made under the same conditions as Example 3 except that a single tinned soft conductor (ϕ0.12 mm) was used as the stranded conductor 14 forming the stranded conductor shield layer 15 in Example 3 and a single served shield layer was formed by winding the stranded conductor 14 at the winding angle of 30±5° so as to be densely arranged.

Comparative Example 6

A shielded cable was made under the same conditions as Example 1 except that a tinned annealed copper wire braided shield layer was formed by braiding plural tinned annealed copper wires (ϕ0.12 mm) instead of forming the stranded conductor shield layer 15 in Example 1.

The tests for 4 items, which are the bending durability, the torsion durability, the shielding performance and the temperature increase in shield layer, were conducted on the shielded cables according to Examples 1-3 and Comparative Examples 1-6.

The bending durability test was conducted based on IEC 60227-2, technical standards for electrical appliances. A weight was connected to a lower end of the shielded cable, the substantially middle portion of the shielded cable was sandwiched by two rolls with a radius of 30 mm, and the shielded cable was repeatedly bent at a bending radius of R30 so that upper ends of the shielded cable open 180° on both sides with reference to the portion sandwiched by the two rolls, thereby deriving the number of bending cycles until the disconnection of the conductor strand (tinned soft conductor, tinsel copper) which forms the shield layer.

In the torsion durability test, one end of the shielded cable was fixed and another end which is not fixed was repeatedly twisted in an outer diameter direction at a torsional displacement of ±0.3°/mm, thereby deriving the number of torsional cycles until the disconnection of the conductor strand (tinned soft conductor, tinsel copper) which forms the shield layer. The torsional displacement here is derived by dividing a torsion angle [°] of the other end of the shielded cable in the outer diameter direction by a cable length [mm].

The shielding performance test was conducted in accordance with CISRPR25 (International standard for radiation noise measurement of in-vehicle electric equipment). The length of the shielded cable to be evaluated was 1 m, a signal generator was connected to one end, another end was terminated with a 50Ω BNC connector and was housed in a measuring room which is formed of an electromagnetic wave absorber, a signal with sine wave of 24 d Bm was input into the shielded cable from the signal generator and electromagnetic wave (electromagnetic noise) emitted from the shielded cable was measured by a receiving antenna provided in the measuring room, thereby measuring the shielding performance.

In this test, the shielding performance of the shielded cable of Comparative Example 6 is defined as 1, and a ratio to the performance of Comparative Example 6 is shown. It should be noted that the shielding performance is defined as a value which is derived by subtracting the electromagnetic emission level of each shielded cable of Examples and Comparative Examples from the preliminarily measured electromagnetic emission level of the cable not having a shield layer.

For the temperature increase test of the shield layer, a direct current of 10 amperes was passed through the shield layer of the shielded cable, and temperature variation in 10 minutes was measured and compared.

The results of the above tests are shown in Table 1.

TABLE 1

| | | Bending durability (Number of bending cycles) | Torsion durability (Number of torsional cycles) | Temperature increase in shield layer | Shielding performance |
|---|---|---|---|---|---|
| Example 1 (Structure of FIG. 1) | Stranded conductor shield layer | 500,000 cycles or more | 500,000 cycles or more | About 8° C. | 0.2 |
| Example 2 (Structure of FIG. 3) | Stranded conductor shield layer Tinsel copper braided shield layer | 500,000 cycles or more | 500,000 cycles or more | About 7° C. | 0.9 |
| Example 3 (Structure of FIG. 4) | Stranded conductor shield layer Metal plated strand braided shield layer | 500,000 cycles or more | 500,000 cycles or more | About 7° C. | 0.9 |
| Example 4 (Structure of FIG. 5) | Stranded conductor shield layer (with reinforcing braided layer) | 500,000 cycles or more | 500,000 cycles or more | About 8° C. | 0.2 |
| Comparative Example 1 | Single served shield layer | About 400,000 cycles | About 100,000 cycles | About 10° C. | 0.3 |
| Comparative Example 2 | Tinsel copper braided shield layer | 500,000 cycles or more | 500,000 cycles or more | About 40° C. | 0.9 |
| Comparative Example 3 | Single served shield layer Tinsel copper braided shield layer | About 400,000 cycles | About 100,000 cycles | About 7° C. | 0.9 |
| Comparative Example 4 | Metal plated strand braided shield layer, only | 500,000 cycles or more | 500,000 cycles or more | About 40° C. | 0.9 |
| Comparative Example 5 | Single served shield layer Metal plated strand braided shield layer | About 400,000 cycles | About 100,000 cycles | About 7° C. | 0.9 |
| Comparative Example 6 | Tinned annealed copper wire braided shield layer | About 50,000 cycles | About 100,000 cycles | About 5° C. | 1 |

The cables of Examples 1, 2, 3 and 4 and Comparative Examples 2 and 4 were not disconnected in the bending durability test and the torsion durability test even at over 500,000 cycles or more. However, in the bending durability test, the disconnection occurred at 400,000 cycles in Comparative Examples 1, 3 and 5 and at 500,000 cycles in Comparative Example 6, and in the torsion durability test, the disconnection occurred at 100,000 cycles in Comparative Examples 1, 3, 5 and 6.

The shielding performance of Examples 1 and 4 is less than half of the shielding performance of Comparative Example 6 which shows the best shielding performance, however, there is no problem even with the shielding performance of Example 1 depending on the application in which the shield layer is relatively not critical, e.g., in the case where the generation source of noise itself is small or in the case where not many devices which are improperly operated due to the noise are present nearby. In addition, a shield layer having a complex shielding structure as is Example 2 or 3 has the shielding performance substantially equivalent to that of Comparative Example 6.

The shield temperature increase in Examples 1, 2, 3 and 4 shows the performance substantially equivalent to that of Comparative Example 6 of which shield temperature increase is the smallest. On the other hand, in Comparative Examples 2 and 4, although the results of the bending durability, the torsion durability and the shielding performance are substantially the same as Examples 2 and 3, the temperature increase is high as 40° C.

This revealed that the shielded cables of Examples 1, 2, 3 and 4 are excellent in the bending durability and the torsion durability, and suppress the temperature increase in the shield layer when the noise current flows.

Although the winding direction of the stranded conductor 14 with respect to the central axis of the core 13 is the same as the twisting direction of the stranded conductor 14 itself in the present embodiment, the directions may be different.

Next, the shielded cable was made under the same conditions as Example 1 except that the winding angle is different, and then, the bending durability (the number of bending cycles) was examined. The test results are shown in Table 2. The already-described method was used for the bending durability test.

TABLE 2

| Winding angle | 15 ± 2° | 20 ± 2° | 25 ± 2° | 30 ± 2° | 35 ± 2° |
|---|---|---|---|---|---|
| Bending durability (Number of bending cycles) | 400,000 cycles | 600,000 cycles | 700,000 cycles | 1 million cycles or more | 1 million cycles or more |

As shown in Table 2, when the winding angle was determined to be 15±2° including an error due to the performance of the manufacturing machine, the disconnection occurred at 400,000 cycles in the bending durability test. When the winding angle was determined to be 20±2°, the disconnection occurred at 600,000 cycles in the bending durability test. When the winding angle was determined to be 25±2°, the disconnection occurred at 700,000 cycles in the bending durability test. In contrast, the disconnection did not occur in the bending durability test even at 1,000,000 cycles or more when the winding angle was determined to be 30±2°. When the winding angle was determined to be 35±2°, the disconnection did not occur in the bending durability test even at 1,000,000 cycles or more.

Meanwhile, shielded cables were made under the same conditions as Examples 2-4 except that the winding angle is different, then, the same bending durability test was conducted on these shielded cables, and the tendency similar to the bending durability test of the shielded cable described in Example 1 (the tendency that the bending durability is remarkably improved when the winding angle is 30±2° or more) was observed also in this bending durability test.

The winding angle of more than 80° is not preferable since the manufacturing of the shielded cable is technically difficult.

From the above, it was revealed that the bending durability of the shielded cable is remarkably improved when the winding angle defined by the stranded conductor and the central axis of the core is 30-80° for spirally winding the stranded conductor around the outer periphery of the core.

Although the invention has been described with respect to the specific embodiments for complete and clear disclosure, the appended claims are not to be therefore limited but are to be construed as embodying all modifications and alternative constructions that may occur to one skilled in the art which fairly fall within the basic teaching herein set forth.

What is claimed is:

1. A shielded cable, comprising:

a core comprising an insulated wire comprising an inner conductor and an insulation layer formed on an outer periphery of the inner conductor;

a shield layer formed on an outer periphery of the core; and a jacket layer formed on an outer periphery of the shield layer, wherein the shield layer comprises a stranded conductor shield layer comprising a stranded conductor wire spirally wound around the core, and wherein the stranded conductor wire comprises a plurality of conductor strands twisted together.

2. The shielded cable according to claim 1, wherein the shield layer further comprises a tinsel copper braided shield layer that is formed between the core and the stranded conductor shield layer and includes a plurality of braided copper tinsels each of which comprises a core thread and a copper foil wrapped thereon.

3. The shielded cable according to claim 1, wherein the shield layer further comprises a metal plated strand braided shield layer that is formed between the core and the stranded conductor shield layer and includes a plurality of braided metal plated strands each of which comprises a core thread plated with a metal.

4. The shielded cable according to claim 1, wherein a winding angle defined by the stranded conductor wire and a central axis of the core is 10° to 80° when the stranded conductor wire is spirally wound around the outer periphery of the core.

5. The shielded cable according to claim 1, wherein a winding angle defined by the stranded conductor wire and a central axis of the core is 30° to 80° when the stranded conductor wire is spirally wound around the outer periphery of the core.

6. The shielded cable according to claim 1, further comprising a reinforcing braided layer that is formed between the shield layer and the jacket layer and comprises braided shock-absorbing fibers.

7. The shielded cable according to claim 1, wherein the stranded conductor wire further comprises a lubricant applied to the plurality of conductor strands.

8. The shielded cable according to claim 7, wherein the lubricant comprises silicon oil.

9. The shielded cable according to claim 1, wherein the jacket layer consists of ethylene propylene diene rubber.

10. The shielded cable according to claim 1, wherein the jacket layer comprises ethylene propylene diene rubber.

11. The shielded cable according to claim 1, wherein the shield layer further comprises a tinsel copper braided shield layer that comprises a plurality of braided copper tinsels each of which comprises a core thread and a copper foil wrapped thereon.

12. The shielded cable according to claim 1, wherein the shield layer further comprises a metal plated strand braided shield layer that comprises a plurality of braided metal plated strands each of which comprises a core thread plated with a metal.

13. The shielded cable according to claim 1, wherein the conductor strands comprise twisted metal wires.

14. The shielded cable according to claim 1, wherein a portion of the outer periphery of the core is exposed between spirally wound sections of the stranded conductor wire.

* * * * *